US008287189B1

(12) United States Patent
Ulloa-Parra

(10) Patent No.: US 8,287,189 B1
(45) Date of Patent: Oct. 16, 2012

(54) SCENTED DISPOSABLE TRASH BAGS

(76) Inventor: Javier E Ulloa-Parra, Bogota (CO)

( * ) Notice: Subject to any disclaimer, the term of this patent is extended or adjusted under 35 U.S.C. 154(b) by 1430 days.

(21) Appl. No.: 11/893,743

(22) Filed: Aug. 17, 2007

Related U.S. Application Data

(63) Continuation-in-part of application No. 10/801,030, filed on Mar. 15, 2004, now abandoned.

(51) Int. Cl.
*B65D 33/28* (2006.01)

(52) U.S. Cl. ..... 383/72; 383/71; 383/61.4

(58) Field of Classification Search ..... 383/61.4, 383/71, 72
See application file for complete search history.

(56) References Cited

U.S. PATENT DOCUMENTS

| | | | | |
|---|---|---|---|---|
| 4,349,104 | A | 9/1982 | Hayes | |
| 4,747,902 | A * | 5/1988 | Saitoh | 156/244.11 |
| 4,870,924 | A | 10/1989 | Wolfe | |
| 5,006,380 | A * | 4/1991 | Fraser | 428/35.2 |
| 5,119,968 | A | 6/1992 | Palmer | |
| 5,321,007 | A | 6/1994 | Narula et al. | |
| 5,950,818 | A | 9/1999 | Paulsen | |
| 6,054,423 | A * | 4/2000 | McGill | 510/191 |
| 6,409,746 | B1 * | 6/2002 | Igaki et al. | 607/109 |
| 6,630,233 | B1 * | 10/2003 | Levandowski et al. | 428/321.5 |
| 6,737,161 | B2 * | 5/2004 | Weder | 428/409 |
| 6,748,697 | B1 * | 6/2004 | Santa Cruz et al. | 47/71 |
| 2003/0066779 | A1 * | 4/2003 | Desmarais et al. | 206/524.7 |
| 2003/0204001 | A1 * | 10/2003 | Van Gelder et al. | 524/232 |
| 2003/0223657 | A1 * | 12/2003 | Belias et al. | 383/105 |
| 2004/0197524 | A1 * | 10/2004 | Rochford et al. | 428/143 |
| 2008/0212903 | A1 * | 9/2008 | Germanow et al. | 383/42 |

* cited by examiner

*Primary Examiner* — Justin Larson
*Assistant Examiner* — Peter Helvey

(57) ABSTRACT

A disposable bag receptacle includes a body having an open top end portion and a closed bottom end portion. The body defines a cavity extending between the top and bottom end portions and includes a flexible outer surface impregnated with a pesticide. The outer surface further includes a predetermined quantity of aroma substance impregnated therein for emitting a pleasant aroma. The body further includes a plurality of flexible straps having opposed end portions attached to the body. The plurality of straps are connected adjacent the top end portion of the body and are engageable with each other for tying the open top end portion. In an alternate embodiment, the body has a longitudinal axis extending in a substantially horizontal direction.

4 Claims, 3 Drawing Sheets

SCENTED DISPOSABLE TRASH BAGS

CROSS REFERENCE TO RELATED APPLICATIONS

This application is a continuation-in-part of prior application Ser. No. 10/801,030, filed Mar. 15, 2004 now abandoned, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to trash bags and, more particularly, to disposable trash bags having scented films for eliminating odors and bacteria.

PRIOR ART

Disposable plastic trash bags are commonly used in residential and commercial premises, as a convenient means of collecting and disposing of garbage. Plastic trash bags are lightweight and waterproof, and because they are flexible, they take up little space, which makes for easy storage prior to use. As trash accumulates in the bag, noxious germs and odors are generated thereby which permeate the surrounding area. Several trash bag devices exist in the prior art, however, such devices do not adequately address the problem described above.

Accordingly, a need remains for a disposable trash bag which may be securely fastened when closed and having an odor or bacterial control means integral therewith.

BRIEF SUMMARY OF THE INVENTION

In view of the foregoing background, it is therefore an object of the present invention to provide an apparatus for eliminating odors and bacteria in trash bags. These and other objects, features, and advantages of the invention are provided by a scented disposable trash bag receptacle including a body having an open top end portion and a closed bottom end portion.

The body defines a cavity extending between the top and bottom end portions and within the outer surface for receiving objects therein and includes a flexible outer surface impregnated with a pesticide. The body further has a longitudinal axis extending in a substantially vertical direction. The outer surface further includes a predetermined quantity of aroma substance impregnated therein for emitting a pleasant aroma.

In an alternate embodiment, the body has a longitudinal axis extending in a substantially horizontal direction. A bottom surface extends along the axis of the body with the outer surface extending substantially vertically and upwardly from the bottom surface.

The body further includes a plurality of flexible straps having opposed end portions attached to the body and extending outwardly therefrom respectively. The plurality of straps are formed from durable material and are connected adjacent the top end portion of the body. Such straps are engageable with each other for tying the open top end portion. The plurality of flexible straps each have a respective centrally disposed longitudinal axis and further have opposed side portions equally spaced therefrom and extending substantially parallel to the corresponding axis and along a length thereof respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout and prime numbers refer to alternate embodiments of such elements.

Figure 1:
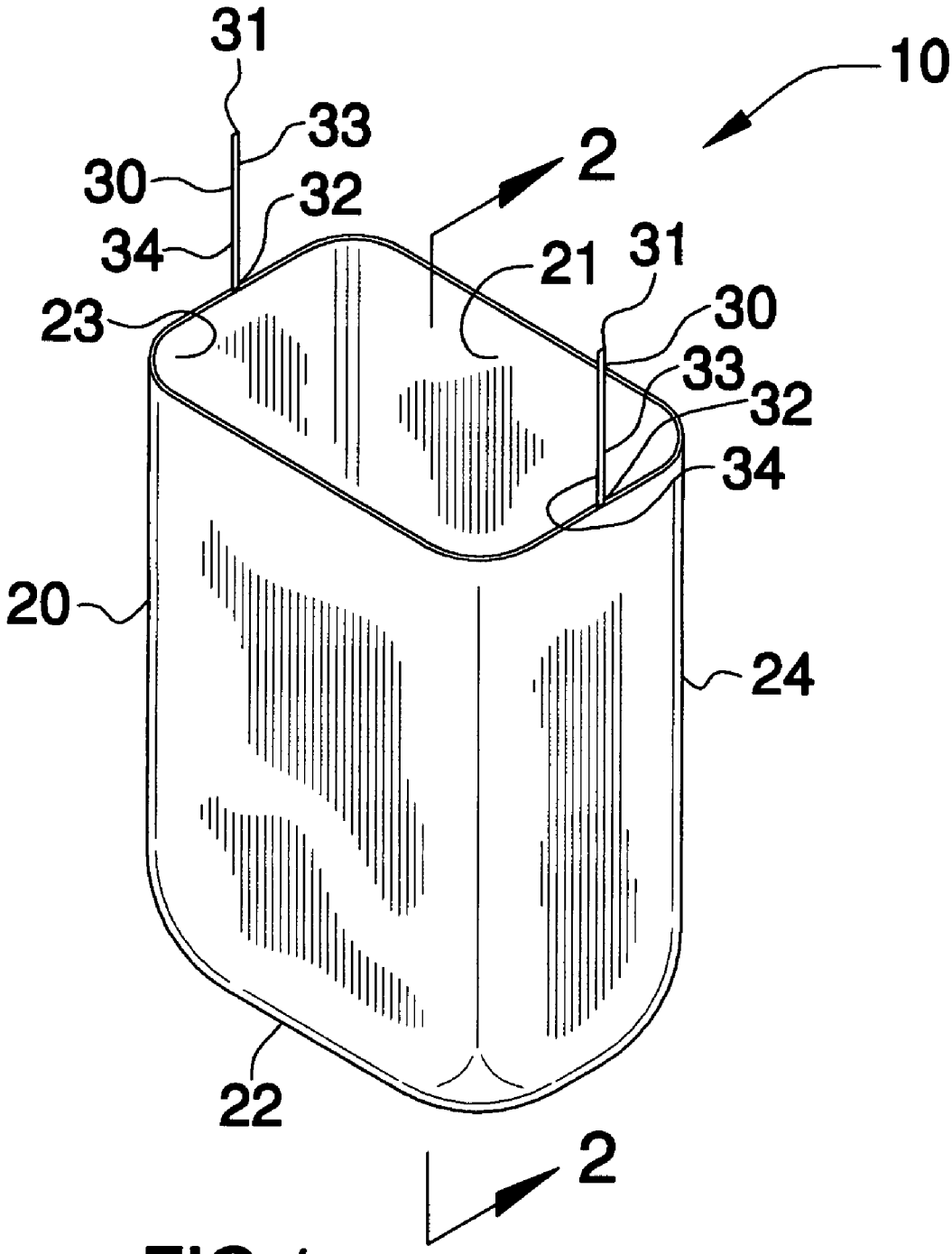
FIG. 1 is a perspective view showing a scented disposable trash bag, in accordance with the present invention.
Figure 2:
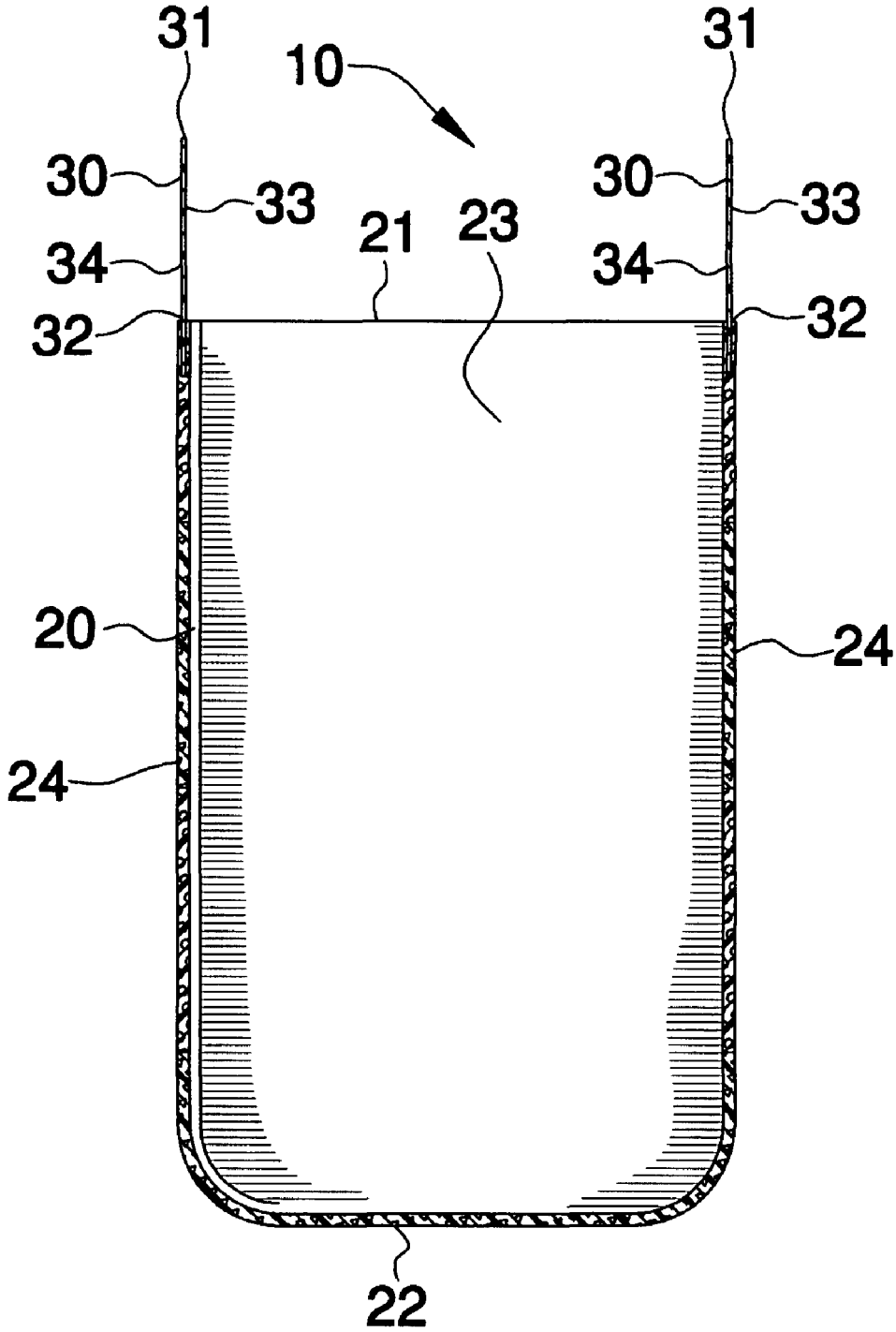
FIG. 2 is a cross-sectional view of the present invention shown in FIG. 1, taken along line 2-2.
Figure 3:
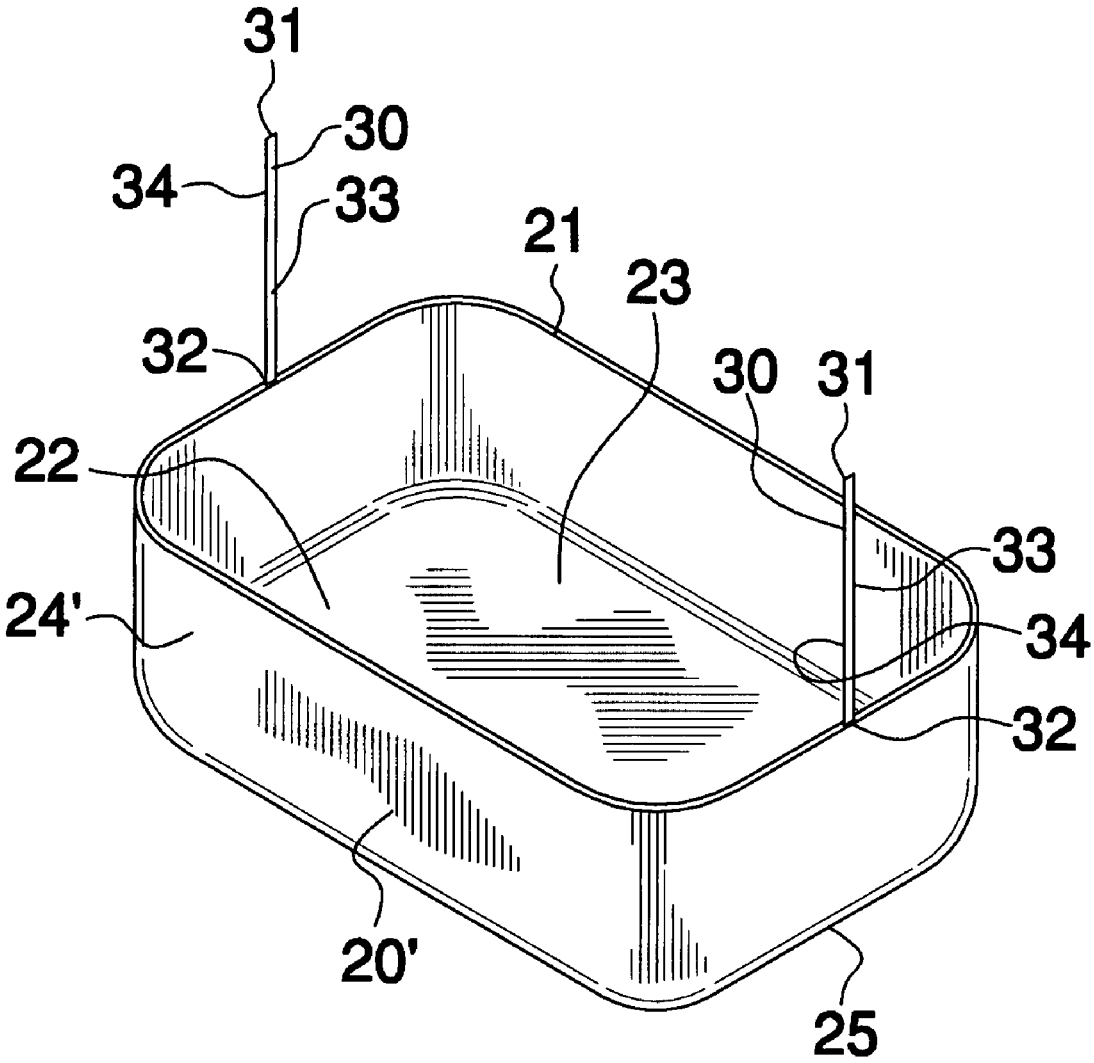
FIG. 3 is a perspective view showing an alternate embodiment of the present invention.

The apparatus of this invention is referred to generally in FIGS. 1-3 by the reference numeral 10 and is intended to provide a scented disposable trash bag for eliminating odors and bacteria. It should be understood that the trash bag 10 may be used to hold and sanitize many different types of objects and should not be limited to only trash.

Referring initially to FIGS. 1 and 2, the trash bag 10 includes a body 20 having an open top end portion 21 and a closed bottom end portion 22. The body 20 defines a cavity 23 extending between the top 21 and bottom 22 end portions and includes a flexible outer surface 24 impregnated with a conventional pesticide for receiving objects therein. The pesticide repels pests and insects naturally attracted to garbage and deters them from entering or hovering about the trash bag 10.

The outer surface 24 further includes a predetermined quantity of aroma substance impregnated therein for emitting a pleasant aroma, as best shown in FIG. 2. The pleasant aroma helps mask the smell of garbage, thereby reducing the attraction of small animals to an exterior trash container and improving the smell of an interior trash container. The body 20 further has a longitudinal axis (not shown) extending in a substantially vertical direction.

Now referring to FIG. 3, in an alternate embodiment, the body 20' has a longitudinal axis (not shown) extending in a substantially horizontal direction. A bottom surface 25 extends along the axis of the body 20' with the outer surface 24' extending substantially vertically and upwardly from the bottom surface 25. Such an embodiment is ideal for small, odorous waste objects such as disposable diapers, pet litter or pet excrement.

Referring back to FIGS. 1 and 2, the body 20 further includes a plurality of flexible straps 30 having opposed end portions 31, 32 attached to the body 20 and extending outwardly therefrom respectively. The plurality of straps 30 are formed from durable material and are connected adjacent the top end portion 21 of the body 20. The plurality of straps 30 are easily tied by a user to close the top end portion 21 when a user desires to dispose of the trash bag 10. The plurality of flexible straps 30 each have a respective centrally disposed longitudinal axis (not shown) and further have opposed side portions 33, 34 equally spaced therefrom and extending substantially parallel to the corresponding axis and along a length thereof respectively.

This improved trash bag 10 is designed to deter insects from trash containers and kill bacteria that grow in garbage. The trash bag 10 could be used in commercial and industrial applications as well as residential ones. The pleasant aroma of the trash bag 10 reduces odors and enhances the livability of a room having trash containers.

Aromas such as vanilla, talc, citronella, and lavender, as examples, may be impregnated into a polymer that is then formed into a trash bag. A kilogram of vanilla aroma includes predetermined quantities of the ingredients listed hereinbelow.

| | |
|---|---|
| Castor Oil | 180 GRAMS |
| Anisaldehyde and derivatives thereof | 55 GRAMS |
| Vanilla and derivatives thereof | 25 GRAMS |
| Eugenol and derivatives thereof | 10 GRAMS |
| Coumarin and derivatives thereof | 50 GRAMS |
| C-14 Aldehyde | 40 GRAMS |
| Cinnamic Alcohol and derivatives thereof | 400 GRAMS |
| Benzoate Benzyl and derivatives thereof | 110 GRAMS |

The process to impregnate the polymer with the aroma includes the steps of warming the polymer to a temperature between 40 and 50 degrees centigrade, adding the polymer to a centrifuge, adding 0.004 grams of vanilla aroma per one kilogram of polymer, and allowing the mixture to rest for approximately twenty seconds. The steps further include passing the mixture through an extruder, and forming the mixture into a trash bag. Of course, such an aroma can be increased and decreased as desired as is well known to those skilled in the art.

A kilogram of talc aroma includes predetermined quantities of the ingredients listed hereinbelow.

| | |
|---|---|
| AcetateTerpinilico and derivatives thereof | 115 GRAMS |
| Terpineol esters | 90 GRAMS |
| Citric Oil | 30 GRAMS |
| Linalol and Derivatives | 95 GRAMS |
| Liliales | 45 GRAMS |
| Alpha Aldehydes and Hexil Cinnamic | 140 GRAMS |
| Coumarin | 30 GRAMS |
| Benzyl Alcohol and derivatives thereof | 105 GRAMS |
| Solvent DPG | 310 GRAMS |
| Vanilla | 40 GRAMS |

Impregnation of the polymer with talc aroma is substantially similar to the process for impregnating the polymer with vanilla aroma.

A kilogram of citronella aroma includes predetermined quantities of the ingredients listed hereinbelow.

| | |
|---|---|
| Citronella Oil | 150 GRAMS |
| Eucalyptus Oil | 20 GRAMS |
| Citric Oil | 80 GRAMS |
| C-9 Aldehyde and derivatives thereof | 5 GRAMS |
| Benzyl Alcohol and derivatives thereof | 30 GRAMS |
| Alcohol Terpenilo and derivatives thereof | 150 GRAMS |
| Acetophenone | 25 GRAMS |
| Axido Difenilo and derivatives thereof | 220 GRAMS |
| Solvent DPG | 280 GRAMS |
| Cajeputene | 40 GRAMS |

Impregnation of the polymer with citronella aroma is substantially similar to the process for impregnating the polymer with vanilla aroma and talc aroma respectively.

A kilogram of lavender aroma includes predetermined quantities of the ingredients listed hereinbelow.

| | |
|---|---|
| Eucalyptus Oil | 320 GRAMS |
| C8-C10 Aldehydes | 150 GRAMS |
| Linalol and derivatives thereof | 80 GRAMS |
| Benzyl Alcohol and derivatives thereof | 10 GRAMS |
| Benzoate Methyl | 20 GRAMS |
| Undecanoana | 10 GRAMS |
| Terpineol and derivatives thereof | 130 GRAMS |
| Solvent DEP | 100 GRAMS |
| Castor Oil | 80 GRAMS |

Impregnation of the polymer with lavender aroma is substantially similar to the process for impregnating the polymer with vanilla aroma, talc aroma, and citronella aroma respectively.

Linalol is defined as an intense floral aroma having a chemical structure of: 3-7 dimethyl-1, 6. Lilial is defined as a fresh, strong floral aroma having a chemical structure of: 2-methyl-3-(4-tert-butylphenyl) (propanal). Hexyl Cinnimac is defined as a jazmin aroma having a chemical structure of: alpha Hexylcinnamaldehyde 95% FCC. Alchohol Terpenilol is defined as a pine aroma having a chemical structure of: 3-cyclohexene-1-methanol, alpha-4-trymethyl. Oxidize Difenilo is defined as a geranium-rose floral aroma having a chemical structure of: Benzene, 1,1 oxybis. Undecanoanac is defined as citric rose aroma having a chemical structure of: 10 undecenal. Such elements are understood by one skilled in the art.

A method of eliminating odors while employing a disposable bag receptacle includes the steps of providing a body, formed from a polymer, which has an open top end portion and a closed bottom end portion. Such a body includes a flexible outer surface and defines a cavity extending between the top and bottom end portions. The steps further include impregnating the body with a pesticide for thwarting off insects, impregnating the body with a predetermined quantity of aroma, placing debris and other items within the body, attaching a plurality of flexible straps that have opposed end portions to the body and extending outwardly therefrom respectively, and tying the plurality of straps to each other. The plurality of flexible straps each has a respective centrally disposed longitudinal axis and further has opposed side portions equally spaced therefrom and extending substantially parallel to the corresponding axis and along a length thereof respectively. The straps cooperate when tied together to prevent the contents of the bag from prematurely and undesirably exiting the bag during operating conditions.

The body has a longitudinal axis extending in a substantially vertical direction. The body further has a longitudinal axis extending in a substantially horizontal direction. The body further has a bottom surface extending along the axis of the body with the outer surface extending substantially vertically and upwardly from the bottom surface. The plurality of straps are formed from durable material and are connected adjacent the top end portion of the body.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A disposable bag receptacle comprising:

a body having an open top end portion and a closed bottom end portion, said body including a flexible outer surface impregnated with a pesticide for thwarting off insects and further including a predetermined quantity of aroma substance impregnated therein for emitting a pleasant aroma, said body defining a cavity extending between said top and bottom end portions and within said outer surface for receiving objects therein; and a plurality of flexible straps having opposed end portions attached to said body and extending outwardly therefrom respectively, said plurality of straps being engageable with each other for tying the open top end portion, said plurality of flexible straps each having a respective centrally disposed longitudinal axis and further having opposed side portions equally spaced therefrom and extending substantially parallel to the corresponding axis and along a length thereof respectively;

wherein said aroma substance comprises vanilla aroma comprising a predetermined quantity of castor oil;

a predetermined quantity of anisaldehyde;

a predetermined quantity of vanilla;

a predetermined quantity of eugenol;

a predetermined quantity of coumarin;

a predetermined quantity of C14 aldehyde;

a predetermined quantity of cinnamic alcohol; and a predetermined quantity of benzyl benzoate.

2. The disposable bag receptacle of claim 1, further comprising talc aroma comprising:

a predetermined quantity of terpineol acetate;

a predetermined quantity of terpineol ester;

a predetermined quantity of citric oil;

a predetermined quantity of linaleol;

a predetermined quantity of liliales;

a predetermined quantity of cinnamic aldehyde;

a predetermined quantity of coumarin;

a predetermined quantity of benzyl alcohol; and a predetermined quantity of vanilla.

3. The disposable bag receptacle of claim 1, further comprising citronella aroma comprising:

a predetermined quantity of citronella oil;

a predetermined quantity of eucalyptus oil;

a predetermined quantity of citric oil;

a predetermined quantity of C9 aldehydes;

a predetermined quantity of benzyl alcohol;

a predetermined quantity of terpenilo alcohol;

a predetermined quantity of acetophenone;

a predetermined quantity of axido difenil;

a predetermined quantity of solvent DPG; and a predetermined quantity of cajeputene.

4. The disposable bag receptacle of claim 1, further comprising lavender aroma comprising:

a predetermined quantity of eucalyptus oil;

a predetermined quantity of C8-C10 aldehydes;

a predetermined quantity of Linalool;

a predetermined quantity of benzyl alcohol;

a predetermined quantity of methyl benzoate;

a predetermined quantity of undecanoana;

a predetermined quantity of terpineol;

a predetermined quantity of solvent DEP; and a predetermined quantity of castor oil.

* * * * *